US005934500A

United States Patent [19]

Cogger et al.

[11] Patent Number: 5,934,500

[45] Date of Patent: Aug. 10, 1999

[54] CONTAINER SEALING STRUCTURE FOR FLEXIBLE CONTAINERS

[75] Inventors: John Cogger, Irvine, Calif.; Patrick O. diGiovanni, Gilles, France

[73] Assignee: Allergan, Irvine, Calif.

[21] Appl. No.: 09/024,088

[22] Filed: Feb. 17, 1998

[51] Int. Cl.[6] ..... B65D 5/60

[52] U.S. Cl. ..... 220/495.06; 220/658; 215/12.1

[58] Field of Search ..... 220/495.01, 495.03, 220/495.06, 495.08, 1.6, 908.1, 723, 720, 675, 672, 669, 656, 658, 659; 215/11.3, 12.1, 12.2, 13.1; 222/95, 105, 183, 131

[56] References Cited

U.S. PATENT DOCUMENTS

| | | | |
|---|---|---|---|
| 3,232,468 | 2/1966 | Rownd | 215/13.1 |
| 3,476,277 | 11/1969 | Rownd | 215/13 |
| 4,239,132 | 12/1980 | Mueller et al. | 222/212 |
| 4,330,066 | 5/1982 | Berliner | 215/1 |
| 4,379,455 | 4/1983 | Deaton | 220/495.01 |
| 4,449,984 | 5/1984 | Cruz | 220/495.01 |
| 4,469,250 | 9/1984 | Evezich | 222/83.5 |
| 4,595,434 | 6/1986 | Eckstein et al. | 156/69 |
| 4,760,937 | 8/1988 | Evezich | 222/95 |
| 4,771,911 | 9/1988 | Morony et al. | 215/12.1 |
| 4,909,416 | 3/1990 | Evezich | 222/95 |
| 5,217,138 | 6/1993 | Nichols | 220/495.06 |
| 5,230,428 | 7/1993 | McShane | 206/363 |
| 5,305,920 | 4/1994 | Reiboldt et al. | 222/95 |
| 5,312,018 | 5/1994 | Evezich | 222/95 |
| 5,397,026 | 3/1995 | Mayes | 221/1 |
| 5,421,470 | 6/1995 | Dudzik | 215/350 |
| 5,622,282 | 4/1997 | Yazawa et al. | 222/105 |
| 5,829,591 | 11/1998 | Lyons | 220/784 |

*Primary Examiner*—Stephen Castellano
*Attorney, Agent, or Firm*—Walter A. Hackler

[57] ABSTRACT

Container closure apparatus including a rigid container having an open end with a top edge along a collapsible container disposed within the rigid container and having an open end. A cap is provided for covering the rigid and flexible container open ends and a plug seal providing a primary seal between the rigid container and the flexible container. The plug seal includes, in combination, a peripheral outwardly extending wall portion on the flexible container and a depending portion, extending from the cap, for pressing the wall portion against an inside wall of the rigid container. An annular node formed into the flexible container wall provides concentrate sealing pressure between the cap depending portion, the wall portion and the inside wall of the rigid container. A gasket seal provides a secondary seal between the rigid container and the flexible container. The gasket seal includes, in combination, a lip outwardly extending from the flexible container open end and a groove, disposed in the cap means, for pressing the lip against the rigid container top edge. The cap is secured to the rigid container in a position enabling the depending portion means to press the extending wall against the rigid container inside wall and enabling the groove means to press lip against the rigid container top edge.

17 Claims, 2 Drawing Sheets

FIG. 1.
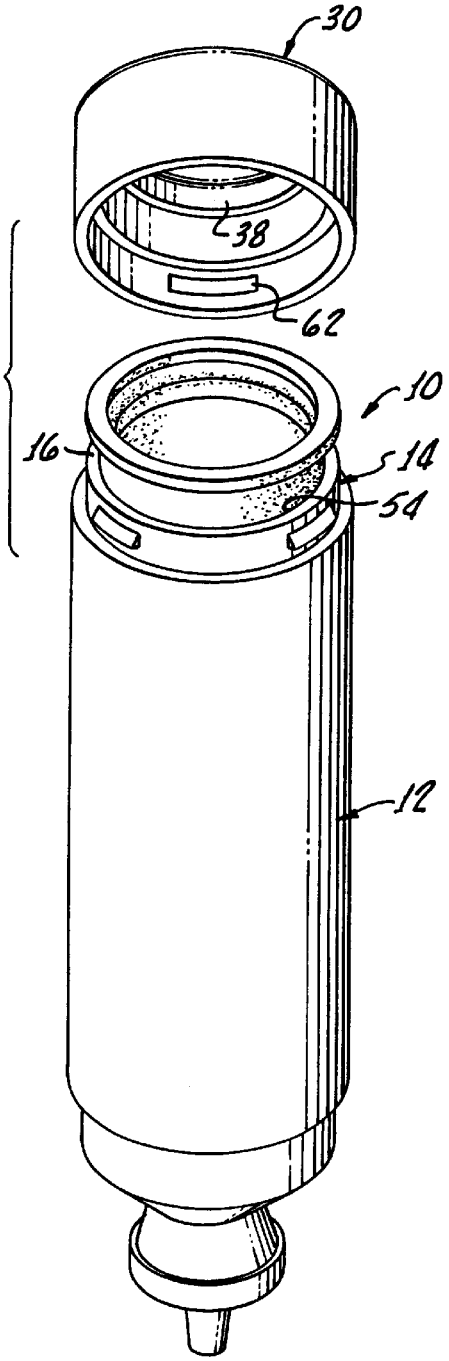
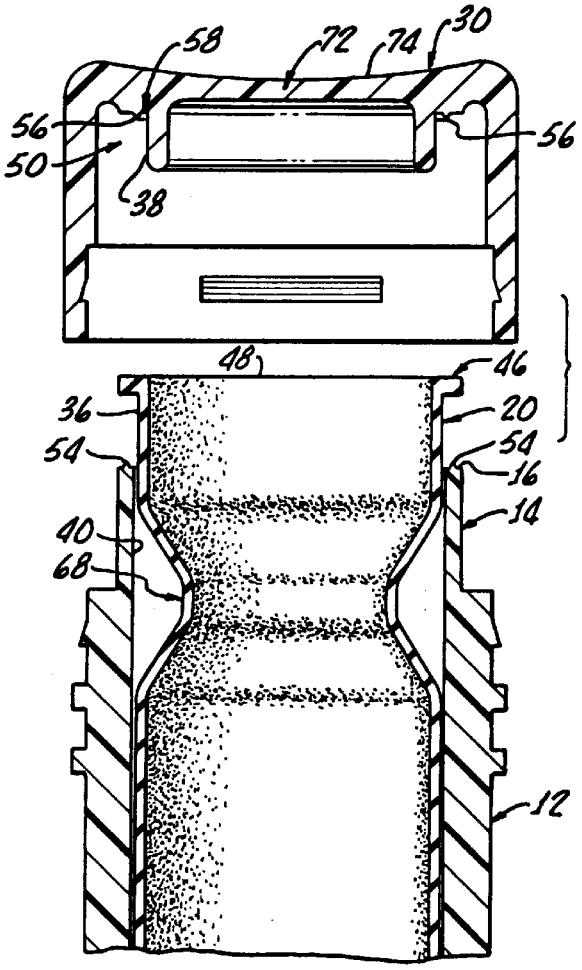
FIG. 2.

CONTAINER SEALING STRUCTURE FOR FLEXIBLE CONTAINERS

The present invention is generally directed to apparatus for administering preservative-free formulations of medicament such as eye drop containers.

More particularly, the present invention is directed to the sealing of packaging which includes a rigid container having a flexible bag or pouch for containing a container for a dropwise dispense.

A wide variety of packages are known which include an outer rigid bottle and inner flexible or collapsible product bag or pouch. The inner product bag collapses as the product is dispensed.

It is obvious that such inner pouches or bags must be formed from materials having little or no interaction with the intended contents thereof in order to prevent contamination of the contained fluids. The selection of container materials is particularly important for drug/pharmaceutical products since changes in a particular drug formulation due to impurities introduced by or through the container wall, and changes in drug formulation over time due to migration of various components through the container walls can have a profound effect on the product performance in both physical and chemical terms.

This problem is acute for flexible or pliable containers or pouches. Many materials having pliability suitable for the construction of collapsible bags or pouches such as polyethylene, Kraton®, C-Flex®, Sarlink®, and the like may not be acceptable due to the adsorption or permeation of certain drug formulations or preservatives therethrough.

However, upon selection of a suitable material or combination of materials, a problem still exists with regard to sealing the formulation within the flexible pouch and at the same time sealing the flexible pouch to the rigid outer container which facilitates handling and dispensing of the formulation from the flexible pouch bag disposed therein.

Accordingly, the present invention is specifically directed to a container closure for such devices.

SUMMARY OF THE INVENTION

A container sealing structure in accordance with the present invention generally includes a rigid container having an open end with a top edge along with a collapsible container disposed therein having an open end.

The cap provides a means for covering the rigid and flexible container open ends. A plug seal provides a means for providing a primary seal between the rigid container and the flexible container with the plug seal means comprising in combination a peripheral outwardly extending wall portion on the flexible container, the wall portion including an annular node formed therein having a thickness larger than a thickness of surrounding areas of the wall portion, and a depending portion compressing the node between the depending portion and an inside wall of the rigid container.

More particularly, the node providing a means for concentrating sealing pressure between the cap depending portion, he wall portion and the inside wall of the rigid container.

A further gasket seal means provides a secondary seal between the rigid container and the flexible container with the gasket seal means comprising in combination a lip outwardly extending from the flexible container open end and a groove disposed in the cap, which provides means for pressing the lip against the rigid container top or edge.

Means are provided for securing the cap to the rigid container in a position enabling depending portion to press the extending wall of the flexible container against the rigid container inside wall and further enabling the groove means to press the lip against the rigid container top edge.

Importantly, means are provided for preventing slippage of the lip from the groove. This is particularly important in assembly of the container closure apparatus in which the cap means is moved into a position pressing the extending wall portion of the flexible container against a rigid container. During this procedure, slippage of the lip groove and from proper position against the top edge of the rigid container is prevented by a pointed raised ridge disposed on a bottom of the groove in combination with a pointed raised ridge disposed on the rigid container top edge.

Preferably, these pointed ridges are aligned with one another to prevent movement of the lip during and after assembly of the container closure apparatus with the cap covering the rigid and the flexible container open ends.

More particularly, the container closure apparatus in accordance with the present invention includes a flexible container with a length greater than the length of the original container and means are provided which define a narrow region in the flexible container for enabling inward folding of a flexible container wall when the cap means is secured to the rigid container. In this manner controlled reliable folding of the flexible container within the rigid container is accomplished.

The extending wall portion of the flexible container is congruent with the lip and the narrow region in the flexible container hereinabove described is disposed adjacent thereto which also prevents a remainder of the flexible container from interfering with the plug seal established between the rigid container and the flexible container.

More particularly, the depending portion of the cap extends from the bottom of the groove to a point along the flexible container past the extending wall portion.

Still more particularly, the node thickness is sufficient to prevent the compression of surrounding areas of the wall portion between the depending portion means and the inside container rigid wall. The node may have a density greater than the density of the surrounding areas of the wall portion and may have a rounded surface thereon for contacting the depending portion of the cap.

Still more particularly, the node may protrude only from one side of the wall portion of the flexible container.

BRIEF DESCRIPTION OF THE DRAWINGS

The present invention can be more readily understood by consideration of the following detailed description, particularly in conjunction with the accompanying drawings in which:

FIG. 1 is a perspective view of a container closure apparatus in accordance with the present invention showing a flexible container or pouch disposed within a rigid container along with a cap for covering the containers;

FIG. 2 is a cross sectional view taken of the top portion of the container shown at FIG. 1 along with the cap displaced therefrom before sealing of the flexible container or pouch within the rigid container;

DETAILED DESCRIPTION

Figure 3:
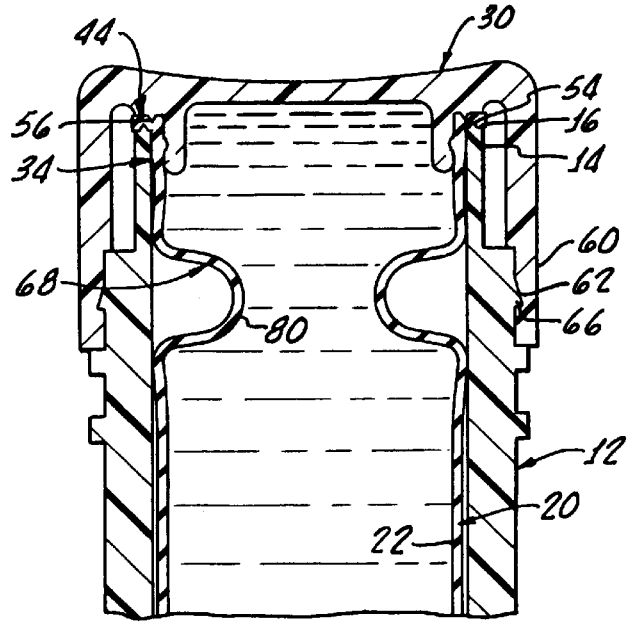
FIG. 3 is a cross sectional view similar to FIG. 2 showing the cap in position and engaging the rigid container with primary and secondary seals established.

Turning now to FIG. 1 there is shown a container closure apparatus 10 which generally includes a rigid container 12 having an open end 14 with an exposed top edge 16 thereon. The rigid container may be formed from any suitable rigid material such as, for example, ABS (Acrylonitrile-Butadiene-Styrene) or polycarbonate.

A flexible container, or pouch 20 disposed within the rigid container 12 provides a means for containing a liquid, not shown. The flexible container 20 may be formed of any suitable thermo plastic elastomer such as, for example, Kraton® rubber. The flexible container or pouch 20 includes a collapsible side wall 22 for enabling the dispersement of the liquid contained therein through a nozzle 26 without entry of ambient air thereinto. The mechanism for dispensing the liquid in the dropwise fashion through the nozzle 26 from the flexible container or pouch 20 is not shown and is not part of the present invention.

The use of a flexible container, or pouch, for dispensing a liquid which is surrounded and generally supported by a rigid container is generally well known in the art. However, it is also well known in the art that problems arise in the sealing of such a flexible pouch within the rigid container to not only prevent the escape of liquid therein, but to provide an airtight seal in order that the liquid to be dispensed from the pouch is not exposed to any environment which may cause the liquid to become non sterile. These devices as can be surmised are typically used for the dispensing of preservative free liquids such as, for example, ophthalmic medications.

The cap, which may be formed from the same material as the rigid container 12, provides a means for covering the rigid container 12 and the flexible container 20 as herein and after described in greater detail.

Figure 4:
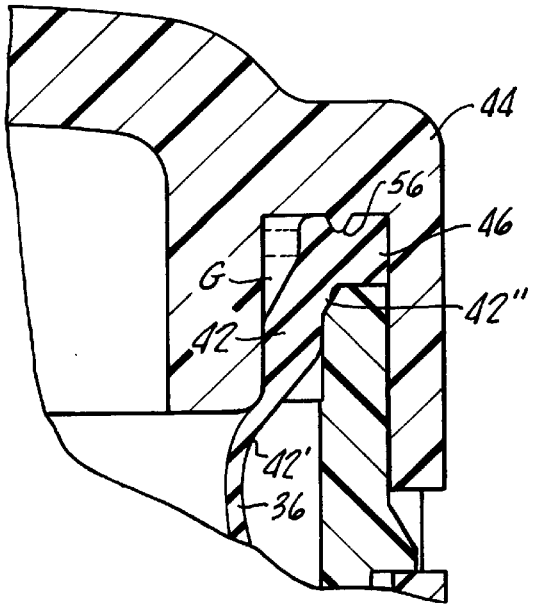
FIG. 4 is an enlarged cross sectional view showing a cap depending portion, wall portion with a node and a portion of the rigid container wall.

A plug seal indicated at 34 (see FIG. 3) provides means for providing a primary seal between the rigid container 14 and the flexible pouch 20 when the cap 30 is in a position covering the rigid container 12 and the flexible pouch 20 as shown in FIGS. 3 and 4. The plug seal 341 comprises, in combination, Peripheral outwardly extending wall 36 from the flexible pouch 20 and the depending portion 38 extending from the cap 30 in a downward fashion, the depending portion 38 providing a means for pressing the extending wall 36 against an inside wall 40 of the rigid container 12.

Figure 5:
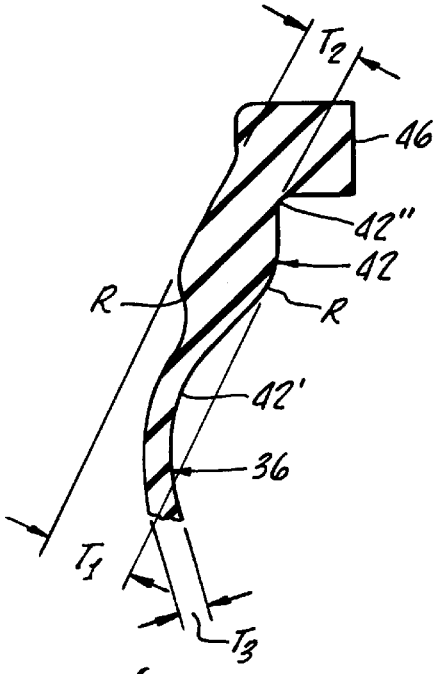
FIG. 5 is a further enlarged cross sectional of the flexible container wall showing the node and an outwardly extending lip.

The flexible container, or pouch, wall 36 includes an annular node 42, see also FIG. 5, extending from both sides of the wall 36. Importantly, the node 42 may have a thickness $T_1$, measured through the wall 36 which is sufficiently greater than a thickness $T_2$, $T_3$ of surrounding areas 42', 42" of the wall 36 to prevent compression of the surrounding areas 42' between the depending portion 38 and rigid container inside wall 40. This is illustrated by the gap G between the areas 42' and cap depending portions, see FIG. 4. Specifically, for a flexible container 20 made of Dynaflex G2701 the node thickness $T_1$ may be from between about 0.040 inches and about 0.051 when the wall thicknesses $T_2$, $T_3$ are between about 0.029 and about 0.034 and 0.013 to 0.016, respectively, inches. Thus, the ratio $T_1/T_2$ may be between about 1.2 and about 1.8 and the ratio $T_1/T_3$ may be between about 2.5 and about 3.9.

During formation of the flexible container by molding or the like, the node 42 density may be measured in a conventional manner in order that it be greater than a density of the wall surrounding ones 42' for the purpose of enhancing the pressure concentration and preventing compression of the wall surrounding area 42'.

Further, the node 42 node may be formed with rounded surfaces R, R for contacting the depending portion 38 and enabling easy passage therepast during assembly. Full contact between the wall 36, and depending portion 38 may present easy assembly.

In addition, the gasket seal indicated at 44 at FIG. 3 provides a secondary seal between the rigid container 12 and the flexible container, or pouch 20. Gasket seal 44 includes, in combination, an outwardly extending lip 46 from an open end 48 of the flexible pouch 20 and a groove 50 disposed in the cap 30 for pressing the lip 48 against the top edge 16 of the rigid container open end 14.

Importantly, pointed raised ridges 54, 56 disposed or formed on the rigid container top edge 16 and a bottom 58 of the groove 50, in combination, provide rib means for preventing slippage of the lip 46 from the groove 50 particularly during assembly of the container closure apparatus 10 in which the cap 30 is moved from a spaced apart position as shown in FIG. 2 to a closed position shown in FIG. 3 in which the cap 30 is secured to the ridge container 12.

Means for securing the cap 30 to the rigid container 12 include a skirt portion 60 which is sized for placement over the rigid container 12 and includes recess portion 62 which engage protruding latch members 66 which provides a means for securing the cap 30 to the rigid container and enabling the depending portion 38 to press the extending wall 36 against the rigid container inside wall 40 as well as enabling the groove bottom 58 to press the lip 46 against the rigid container top edge 16.

As shown in FIGS. 1–4, the flexible container or pouch 20 has a length greater than a length of the rigid container 12 and a narrow region 68 in the pouch wall 20 provides a means for enabling controlled inward folding of the flexible container wall 20 when the cap 30 is secured to the rigid container 12 as shown in FIG. 3.

The lip 46 is congruent with the extending wall 34 and proximate the narrow wall portion 68.

Although there has been hereinabove described a specific arrangement of a container closure apparatus in accordance with the present invention, for he purpose of illustrating the manner in which the invention may be used to its advantage, it should be appreciated that the invention is not limited thereto. Accordingly, any and all modifications, variations or equivalent arrangements which may occur to those skilled in the art, should be considered to be within the scope of the present invention as defined in the dependent claims.

What is claimed is:

1. Container sealing structure comprising:

a rigid container having an open end with a top edge;

a flexible container disposed within said rigid container and having an open end;

cap means for covering the rigid and flexible container open ends;

plug seal means for providing a primary seal between said rigid container and said flexible container, said plug seal means comprising, in combination, a peripheral outwardly extending wall portion on said flexible container, the wall portion including an annular node formed therein having a thickness larger than a thickness of surrounding areas of the wall portion, and depending portion means, extending from said cap means, for comprising the node between the depending portion means and an inside wall of said rigid container;

gasket seal means for providing a secondary seal between said rigid container and said flexible container, said gasket seal means comprising, in combination a lip outwardly extending from said flexible container open end and groove means, disposed in said cap means, for pressing said lip against the rigid container top edge;

means for securing said cap means to said rigid container in a position enabling the depending portion means to press the extending wall against the rigid container inside wall and enabling the groove means to press said lip against the rigid container top edge; and rib means for preventing slippage of the lip from the groove.

2. The container sealing structure according to claim 1 wherein the node thickness is sufficient to prevent compression of the surrounding areas of the wall portion between the depending portion means and the inside container rigid wall.

3. The container sealing structure according to claim 2 wherein the node has a density greater than a density of the surrounding areas of the wall portion.

4. The container sealing structure according to claim 2 wherein the node thickness is between about 0.052 inches and about 3.3 times the thickness of the surrounding areas of the wall portion.

5. The container sealing structure according to claim 4 wherein the node has a rounded surface means for contacting the depending portion means in order to facilitate assembly of the sealing structure.

6. The container sealing structure according to claim 5 wherein the node protrudes from both sides of the wall portion.

7. In container sealing structures having a rigid container with an open end having a top edge; a flexible container disposed within said rigid container and having an open end; a cap for covering the rigid and flexible container open ends; a plug seal for providing a primary seal between said rigid container and said flexible container, said plug seal having a peripheral outwardly extending wall portion and a cap depending portion for comprising the wall portion between the depending portion and an inside wall of said rigid container, an improvement comprising means for concentrating sealing pressure between the cap depending portion, the wall portion and the inside wall of said rigid container, said means for concentrating pressure comprises an annular node formed into the wall portion, the node having a thickness larger than a thickness of surrounding areas of the wall portion, the node has a density greater than a density of the surrounding areas of the wall portion, and the node thickness is sufficient to prevent compression of the surrounding area of the wall portion between the cap depending portion and the rigid container inside rigid container wall.

8. The improvement according to claim 7 wherein the node thickness is between about 0.05 and about 3.2 times the thickness of the surrounding areas of the wall portion.

9. The improvement according to claim 8 wherein the node has rounded surface means for contacting the depending portion.

10. The improvement according to claim 9 wherein the node protrudes from both sides of the wall portion.

11. Container sealing structure comprising:

a rigid container having an open end with a top edge;

a collapsible container disposed within said rigid container and having an open end;

cap means for covering the rigid and flexible container open ends;

plug seal means for providing a primary seal between said rigid container and said flexible container, said plug seal means comprising in combination, a peripheral outwardly extending wall portion on said flexible container, and depending portion means, extending from said cap means, for compressing the wall portion between the depending portion means and an inside wall of said rigid container, said wall portion comprising means for concentrating selling pressure between the cap depending portion, the wall portion and the inside wall of said rigid container;

gasket seal means for providing a secondary seal between said rigid container and said flexible container, said gasket seal means comprising, in combination, a lip outwardly extending from said flexible container open end and groove means, disposed in said cap means, for pressing said lip against the rigid container top edge;

means for securing said cap means to said rigid container in a position enabling the depending portion means to press the extending wall against the rigid container inside wall and enabling the groove means to press said lip against the rigid container top edge; and rib means for preventing slippage of the tip from the groove.

12. The container sealing structure according to claim 11 wherein said means for concentrating pressure comprises an annular node integrally formed into the wall portion, the node having a thickness larger than a thickness of surrounding areas of the wall portion.

13. The container sealing structure according to claim 12 wherein the node thickness is sufficient to prevent compression of the surrounding areas of the wall portion between the depending portion means and the inside container rigid wall.

14. The container sealing structure according to claim 13 wherein the node has a density greater than a density of the surrounding areas of the wall portion.

15. The container sealing structure according to claim 14 wherein the node thickness is between about 0.049 and about 1.27 times the thickness of the surrounding areas of the wall portion.

16. The container sealing structure according to claim 15 wherein the node has rounded surface means for contacting the depending portion means.

17. The container sealing closure structure according to claim 16 wherein the node protrudes from both sides of the wall portion.

* * * * *